US007637137B2

(12) United States Patent
Akamizu et al.

(10) Patent No.: US 7,637,137 B2
(45) Date of Patent: Dec. 29, 2009

(54) PRESS FORMING METHOD OF FORMED MEMBER WITH FLANGE

(75) Inventors: Hiroshi Akamizu, Kakogawa (JP); Jiro Iwaya, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 12/330,830

(22) Filed: Dec. 9, 2008

(65) Prior Publication Data

US 2009/0145310 A1 Jun. 11, 2009

(30) Foreign Application Priority Data

Dec. 11, 2007 (JP) ..... 2007-320074

(51) Int. Cl.
*B21D 5/00* (2006.01)

(52) U.S. Cl. ..... 72/379.2; 29/897.2; 29/897.312

(58) Field of Classification Search ..... 72/362, 72/363, 369, 370.11, 373, 379.2; 100/35; 29/897.2, 897.3, 897.312
See application file for complete search history.

(56) References Cited

U.S. PATENT DOCUMENTS 6,840,283 B2 * 1/2005 Furugen et al. ..... 138/109
6,964,096 B2 * 11/2005 Tryland ..... 29/897.2
2004/0244458 A1 * 12/2004 Yamano et al. ..... 72/350
2005/0262917 A1 * 12/2005 Osumi et al. ..... 72/379.2

FOREIGN PATENT DOCUMENTS

JP 2002-113527 4/2002
JP 2004-130350 4/2004

* cited by examiner

*Primary Examiner*—Jimmy T Nguyen
(74) *Attorney, Agent, or Firm*—Oblon, Spivak, McClelland, Maier & Neustadt, L.L.P.

(57) ABSTRACT

A press forming method which can prevent a stretch-flange crack while using conventional press forming equipment at a time of press forming a formed member with flange includes steps of constructing a blank for press forming with a base body blank portion corresponding to flat base body of the formed member, and a concave flange blank portion formed by bending on a concave outer peripheral edge of the base body blank portion. The concave blank portion is constituted by a convex flange blank portion in which a stretch-flange deformation is generated, and an adjacent flange blank portion which is adjacent thereto. An outer peripheral edge of the convex flange blank portion is formed such that one end exists between two points on a profile line corresponding to an outer peripheral edge of the adjacent flange blank portion, the other end exists between two other points, and the one end and the other end are smoothly connected between the straight lines.

4 Claims, 4 Drawing Sheets

PRESS FORMING METHOD OF FORMED MEMBER WITH FLANGE

TECHNICAL FIELD

The present invention relates to a press forming method of integrally forming a formed member with a flange from a blank (a raw material) worked by a thin plate.

BACKGROUND ART

Various press formed members press formed by using a blank (a raw material) worked by a thin plate such as a steel plate or an aluminum plate are used in a transport vehicle such as a motor vehicle, a vehicle, or a marine vessel, a structure, a machine, an electric appliance and the like. Particularly, in recent year, in the transport vehicle such as the motor vehicle, the vehicle, or the marine vessel, in order to cope with demand to a global environment protection based on a weight saving of a vehicle body, a high strength steel plate and an aluminum alloy plate have been positively employed as a blank material.

As the press formed member, for example, in a seat member, a chassis member and the like for a motor vehicle represented by a lower arm, there is frequently used a formed member provided with a flat base body 41 having a concave outer peripheral edge 42 in which a part of the outer peripheral edge is concaved, and a flange 43 formed by bending on an outer peripheral edge including the concave outer peripheral edge 42, as shown in FIG. 1. The flange 43 has a concave flange portion 44 formed by bending on the concave outer peripheral edge 42. FIG. 2 shows a formed member with a flange for explaining a general mode of the concave flange portion 44. The formed member has a base body 1 having a hourglass shape in a plan view, and a concave outer peripheral edge 2 thereof has an arch shape constructed by a convex curved portion 3 formed by a circular arc in which a center portion is convex to an inner side, and linear adjacent line portions 5 arranged on both sides thereof. A convex flange portion 4 is formed by bending in the convex curved portion 3 of the concave outer peripheral edge 2, an adjacent flange portion 6 is formed by bending in the adjacent line portions 5 on both sides thereof, and a concave flange portion 7 is formed by these flange portions 4 and 6. In this case, in the formed member in FIG. 2, the flange of the formed member is constructed by two opposing concave flange portions 7.

The formed member with the flange is manufactured by using a blank Bp having approximately the same shape as a shape obtained by expanding the formed member in a planar shape as the raw material and bending the flanges 7 and 43 in the base bodies 1 and 41. Specifically, the blank Bp is mounted to an upper flat portion of a die 31 and a pad 32, and the die 31 and the pad 32 are moved upward together, as shown in FIG. 3, and the blank Bp is held to a lower flat portion of a punch 33 by the pad 32 so as to prevent from being deviated its position, the die 31 is moved upward, and the flange is formed by bending on an outer peripheral edge of the base body in accordance with a cooperation between the punch 33 and the die 31, as shown in FIG. 4. In this case, in the illustrated example, the punch 33 is set to a fixed side, and the die 31 is set to a movable side, however, the die 31 may be set to the fixed side and the punch 33 may be set to the movable side, inversely.

If the formed member with flange is press formed by using the blank, there is generated such a deformation that the convex flange portion 4 in the center portion of the concave flange portion 7 is stretched in a peripheral direction (referred to as a "lateral direction") of the concave outer peripheral edge 2 of the base body 1 (the deformation mentioned above is referred to as a "stretch-flange deformation", and the forming generating the stretch-flange deformation is referred to as a "stretch-flange forming"). In a significant case, a crack (referred to as a "stretch-flange crack") CR is generated in a lower end of the center portion of the convex flange portion 4, as shown in FIG. 2. Since a press forming performance is lowered generally in accordance with that a strength of the steel plate becomes higher, it is necessary to develop a steel plate and a forming technique which are excellent in formability, for press forming the formed member with flange having the concave flange portion by using the blank of the high strength steel plate. Further, since the stretch-flange crack comes to a problem, a shape such as a flange height is going to be limited.

Further, since the formability is interior to the steel plate, in the blank of the aluminum alloy plate, a crack tends to be generated in the flange end portion in which the stretch-flange deformation is generated, in the same manner as the case of using the high strength steel plate, in a large-sized and complicated panel formed product, for example, a door outer plate, a seat pan and an oil pan mechanism, in recent years.

Accordingly, in the press forming accompanying the stretch-flange deformation, various crack preventing techniques have been discussed. For example, in Japanese Unexamined Patent Publication No. 2004-130350 (Patent Document 1), there is disclosed a technique preventing a crack by applying an electromagnetic forming to the forming of the shape portion in which the stretch-flange deformation is generated, and generating an extremely high speed stretch-flange deformation, in the press formed product of the aluminum alloy motor vehicle panel. Further, in Japanese Unexamined Patent Publication No. 2002-113527 (Patent Document 2), there is disclosed a technique preventing the stretch-flange crack of the high strength steel plate from being generated by setting a steel plate temperature during forming to 400° C. or higher and 1000° C. or lower at a time of forming the stretch flange, and generating a dynamic recovery of dislocations during work so as to make the dislocations hard to be piled up.

However, in the forming method described in Patent Document 1, since the step of the electromagnetic forming is increased in addition to the normal press forming, it is disadvantageous in the light of productivity, and the high strength steel plate comes short of being worked in comparison with the aluminum alloy in the light of a working force of the electromagnetic forming, so that this forming method is hard to be applied to the forming of the high strength steel plate. Further, in the forming method of Patent Document 2, an increase of the step number is suppressed by finding the minimum places heating the steel plate, however, it is unavoidable that a lead time to an end of the forming is increased in comparison with a conventional cold press, and this forming method is disadvantageous as an industrial forming method in the light of an equipment cost and a productivity.

DISCLOSURE OF INVENTION

The present invention has been made by taking the circumstances mentioned above into consideration, and an object of the present invention is to provide a press forming method which can prevent a stretch-flange crack without lowering a productivity, while using conventional press forming equipment, at a time of press forming a formed member with flange having a convex flange portion by using a blank of a high strength steel plate or an aluminum alloy plate.

In order to relax a concentration of a tensile stress causing the stretch-flange crack generated in a lower portion of a center portion of the convex flange portion by devising a shape of a blank portion (the blank portion for the convex flange) particularly corresponding to the convex flange portion, at a time of press forming the formed member with flange, thereby preventing the crack, the inventor of the present invention has carried out a forming simulation or a forming experiment by an actual press by using the blank forming various blank portions for convex flanges. This has resulted in the completion of the present invention.

In other words, in accordance with the present invention, there is provided a press forming method of forming a formed member with flange by using a blank, wherein the formed member with flange has a flat base body including a concave outer peripheral edge in which a part of an outer peripheral edge is concaved to an inner side, and a flange formed by bending on the concave outer peripheral edge of the base body, wherein the concave outer peripheral edge is provided with a convex curved portion formed by an inside convex curve in a part thereof, and an adjacent line portion formed so as to be connected to both sides of the convex curved portion, and wherein the flange portion is formed by a convex flange portion formed by bending in a convex curved portion of the concave outer peripheral edge, and an adjacent flange portion formed by bending in the adjacent line portion.

In the blank, there are formed a base body blank portion having a flat shape which is approximately equal to a shape of the base body, and a flange blank portion including a convex flange blank portion corresponding to the convex flange portion and an adjacent flange blank portion corresponding to the adjacent flange portion, on a concave outer peripheral edge of the base body blank portion. In a case where a and b are set to both ends of the convex flange blank portion on the concave outer peripheral edge of the base body blank portion, Na and Nb are set to normal lines of curves forming the convex curved portion of the concave outer peripheral edge drawn to the a and b, θ degree is set to an angle formed by the normal lines Na and Nb centering on a nodal point n of the normal lines Na and Nb, a profile line Lp is assumed at a position which is spaced at an equal interval to a flange height H of the adjacent flange portion on an outer side of an adjacent line portion of the concave outer peripheral edge, c and d are set to nodal points between the normal lines Na and Nb and the profile line, and e and f are set to nodal points between straight lines La and Lb forming the θ degree with respect to the normal lines Na and Nb and drawn to the adjacent flange blank portion from the a and b, and the profile line Lp, an outer peripheral edge of the convex flange blank portion is formed such that one end exists between c and e on the profile line Lp, the other end exists between d and f, and the one end and the other end are smoothly connected between the straight lines cd and ef, and an outer peripheral edge of the adjacent flange blank portion is formed by the profile line Lp.

In accordance with the press forming method of the present invention, as shown in FIG. 6, since the outer peripheral edge of the convex flange blank portion receiving the stretch-flange deformation is formed such that its one end exists between c and e on the profile line Lp, the other end exists between d and f, and the one end and the other end are smoothly connected between the straight lines cd and ef, the tensile concentrated stress conventionally causing the stretch-flange crack and generated in the center portion of the outer peripheral edge of the convex flange blank portion is dispersed to both end portions of the outer peripheral edge of the convex flange blank portion, the stress concentration generated in the center portion is relaxed, and it is possible to prevent the stretch-flange crack from being generated. Accordingly, it is possible to efficiently form the formed member with flange by using the conventional press forming equipment without using any special press equipment.

In the press forming method mentioned above, an outer peripheral edge shape (a shape between c and d) of the convex flange blank portion may be formed as a linear shape or an arc-shaped curved form. In the case of forming as the linear outer peripheral edge, on the assumption that a radius of curvature of the convex curved portion forming a part of the concave outer peripheral edge of the base body blank portion is set to R1 mm, it is preferable to connect the outer peripheral edge of the convex flange blank portion and the outer peripheral edge of the adjacent flange blank portion via a round portion having a radius equal to or more than 5 mm and equal to or less than R1 mm. Further, in the case where the blank is formed by a high strength steel plate, it is possible to use a cold rolled steel plate having a tensile strength between about 590 and 1470 MPa.

In accordance with the present invention, since the formed member with flange is press formed by using the blank in which the outer peripheral edge of the convex flange blank portion is formed in a predetermined range, it is possible to disperse the tensile stress concentration generated in the convex flange portion of the formed member to its both end portions, and it is possible to suppress the stretch-flange crack. Accordingly, it is possible to efficiently press form the formed member with flange without using any special press forming equipment. Particularly, in the case of using the blank formed by the high strength steel plate in which the stretch-flange crack tends to be generated, it is excellent in the effect of suppressing the stretch-flange crack.

BEST MODE FOR CARRYING OUT THE INVENTION

Since a press forming method in accordance with the present invention is characterized by a blank used for forming, particularly a shape of a portion corresponding to a convex flange portion of a formed member, a description will be given by focusing thereon. Further, the formed member with flange has various shapes, however, a description will be given of a formed example of the formed member provided with a general convex flange portion shown in FIG. 2 as an embodiment.

Figure 5:
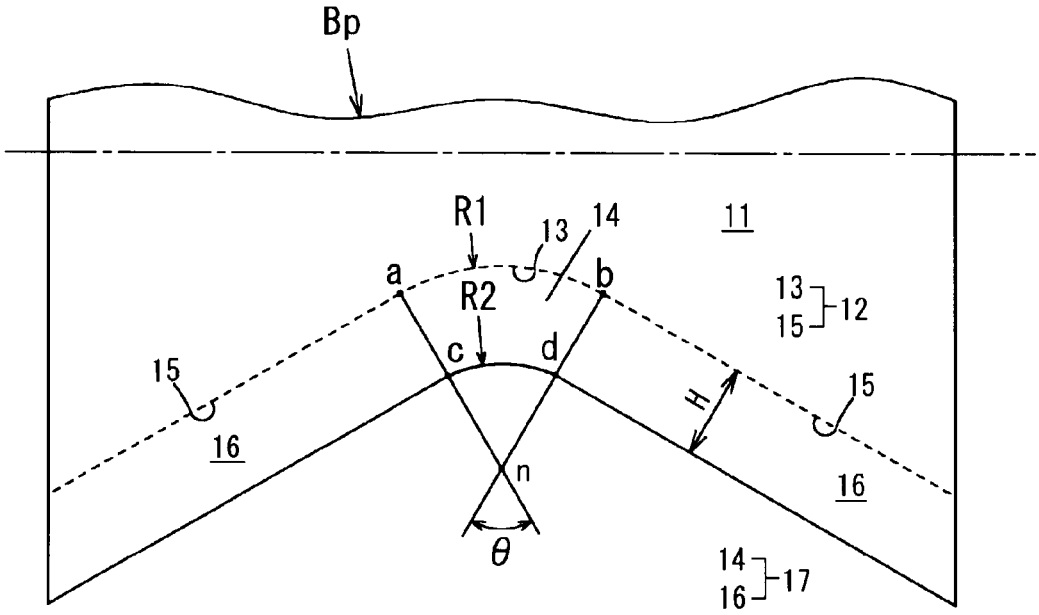
FIG. 5 is a plan view of a substantial part of a conventional blank of the formed member with flange having the hourglass plane shape.

First, a description will be given of a shape of a conventional blank used at a time of press forming the formed member shown in FIG. 2. A conventional blank Bp is constructed by a base body blank portion 11 having a hourglass shape which is approximately the same as a shape of a base body 1 of the formed member, and a concave flange blank portion 17 formed on a concave outer peripheral edge 12 concaved as a concave shape in the base body blank portion 11, as shown in FIG. 5. The concave flange blank portion 17 corresponds to a concave flange portion 7 of the formed member. In this case, a shape line (shown by a broken line in FIG. 5) forming the concave outer peripheral edge 12 of the base body blank portion 11 in which the concave flange blank portion 17 is formed, is referred to as a "bend line", and the concave flange blank portion 17 is formed by bending along the bend line.

The concave outer peripheral edge 12 is constituted by a convex curved portion 13 formed in a center portion and formed by an inside protruded circular arc, and linear adjacent line portions 15 formed on both sides thereof, a convex flange blank 14 is formed in the convex curved portion 13, and a flat adjacent flange blank portion 16 which is adjacent to the convex flange blank portion 14 is formed in the adjacent line portion 15. The concave flange blank portion 17 is constructed by the convex flange blank portion 14 and the adjacent flange blank portion 16 which is adjacent thereto.

In the convex flange blank portion 14, in the case of setting both ends of the convex flange blank portion 14 to a and b on the concave outer peripheral edge 12 of the base body blank portion 11, setting normal lines of the concave outer peripheral edge 12 of the base body blank portion drawn to the a and b to Na and Nb, and setting nodal points between an outer peripheral edge of the adjacent flange blank portion 16 and the normal lines Na and Nb to c and d, on the concave outer peripheral edge of the base body flank portion 11, a shape of an outer peripheral edge (c-d) of the convex flange blank portion is decided in such a manner that a radius of curvature R1 of a circular arc ab (the convex curved portion 13) becomes identical to a radius of curvature of a circular arc cd (R2=R1).

Next, a description will be given of a shape of the blank in accordance with an embodiment of the present invention with reference to FIG. 6. In a blank B in accordance with the embodiment, since a basic structure is the same as the conventional blank Bp although a shape of the outer peripheral edge of the convex flange blank portion is different from the conventional blank Bp, a description will be given of the same structure portions by using the same names and the same reference numerals.

In the same manner as the conventional blank Bp, the blank B in accordance with the embodiment is constructed by a base body blank portion 11 having a hourglass shape, and a concave flange blank portion 17 formed on a concave outer peripheral edge 12 concaved as a concave shape, and the concave flange blank portion 17 is constructed by a convex flange blank portion 14 formed in a center portion of the concave outer peripheral edge 12, and flat adjacent flange blank portions 16 formed in linear adjacent line portions 15 which are adjacent to both sides of a convex curved portion 13 of the concave outer peripheral edge 12. The basic structure mentioned above is the same as the conventional blank B1.

In the blank B in accordance with the embodiment, a and b are set to both ends of the convex curved portion 13 (the radius of curvature R1) (both ends of the convex flange blank portion 14) on the concave outer peripheral edge 12 of the base body blank portion 11, Na and Nb are set to normal lines of the convex curved portion 13 (its radius of curvature being R1) drawn to the a and b, and θ degree is set to an angle formed by the normal lines Na and Nb centering on a nodal point n of the normal lines Na and Nb. Further, a profile line Lp is assumed at a position which is spaced at an equal interval to a flange height H of the adjacent flange portion 6 on an outer side of an adjacent line portion 15 of the concave outer peripheral edge 12, and c and d are set to nodal points between the normal lines Na and Nb and the profile line Lp. Further, e and f are set to nodal point between straight lines La and Lb forming the θ degree, preferably 5θ/6, with respect to the normal lines Na and Nb and drawn to the adjacent flange blank portion 16 from the a and b, and the profile line Lp. At this time, an outer peripheral edge of the convex flange blank portion 14 is formed such that one end of the shape line of the outer peripheral edge exists between c and e on the profile line Lp, the other end exists between d and f, and the one end and the other end are smoothly connected between the straight line cd and the straight line ef. On the other hand, an outer peripheral edge of the adjacent flange blank portion 16 is formed by the profile line Lp. A shape of the outer peripheral edge of the convex flange blank portion 14 may be formed as a linear shape which is in parallel to the straight line cd (or the straight line ef), as shown in FIG. 6, or may be formed as a circular arc shaped or oval arc shaped curve in which the one end and the other end are smoothly connected between the straight line cd and the straight line ef, as shown in FIG. 7 (a solid line). In this case, the outer peripheral edge of the convex flange blank portion 14 shown by a two-dot chain line in FIG. 7 forms a circular arc shape which is inscribed in the straight lines ec, cd and df.

Figure 8:
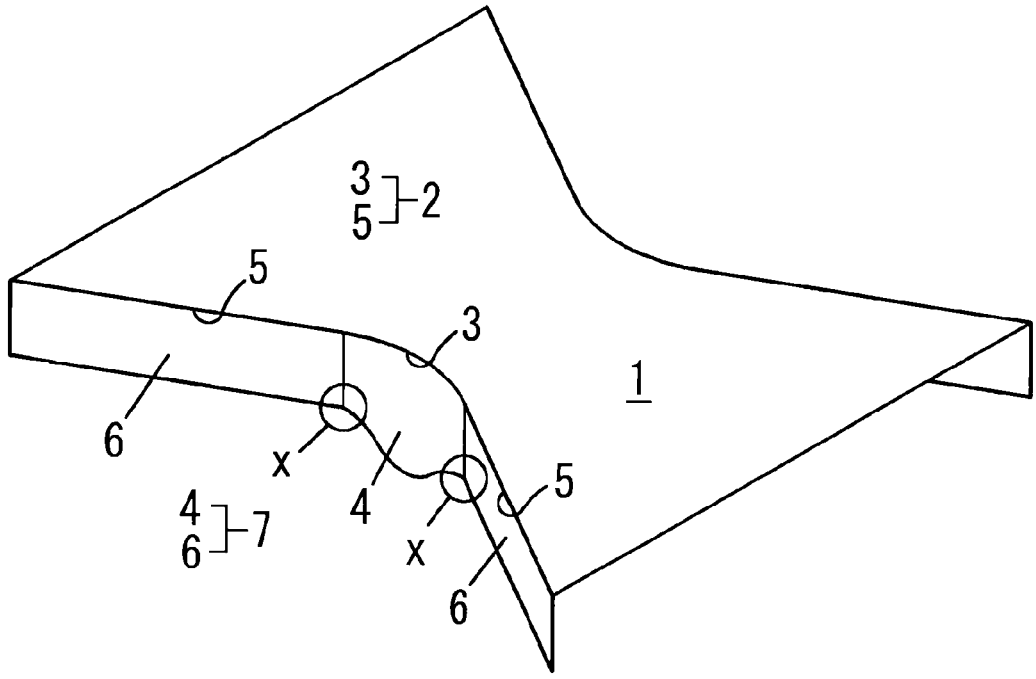
FIG. 8 is an enlarged perspective view of a convex flange portion of a formed member press formed by using the blank in accordance with the present invention and its periphery.

If the shape of the outer peripheral edge of the convex flange blank 14 protrudes from a region cdef, it is hard to disperse the stress concentration applied to the convex flange portion 4 of the formed member to the lower ends of both the end portions (a portion x in the drawing) of the outer peripheral edge at a time of bending, as shown in FIG. 8. Accordingly, the tensile stress is concentrated on the lower end of the center portion of the outer peripheral edge of the convex flange portion 4 or the portion x, and the stretch-flange crack tends to be generated. Further, if shape comes out to the outer side from the straight line ef, the lower end of the outer peripheral edge of the convex flange portion 4 is going to protrude largely from the lower end of the outer peripheral edge of the adjacent flange portion 6 after forming, and the shape of the convex flange portion becomes improper.

In the case of forming the outer peripheral edge of the convex flange blank portion 14 as the linear shape, if the coupled portion to the outer peripheral edge of the adjacent flange blank portion 6 comes to the bent shape, the stress is going to be concentrated excessively, and the crack tends to be generated in the lower portion (the portion x) of both the end portions of the outer peripheral edge of the convex flange portion 4. Accordingly, it is preferable to smoothly couple the coupled portion via a round portion having a radius which is equal to or more than 5 mm and equal to or less than the radius of curvature R1 mm of the convex curved portion 13. If the radius of the round portion is less than 5 mm, the relaxing effect of the stress concentration in the coupled portion comes short. On the other hand, if it gets over R1, the radius of curvature of the round portion becomes too large so as to become hard to be coupled smoothly, so that the stress dispersing effect in the stretch-flange deformation is going to be lowered. In the case that the round portion is provided, it is preferable that the straight line passing through ce and df and the end point of the round portion are fit between segments ce and df. As a matter of fact, since an extremely short length of about a few millimeters of the round portion forming the coupled portion has an effect, no problem is practically generated as far as an interval between the end portion of the round portion forming the coupled portion and the straight line ef is equal to or less than about one fifth the flange height H, even in the case that the end point of the round portion protrudes to the outer side from e and f.

As a material forming the blank B, it is possible to use various cold rolled steel plates or cold rolled aluminum alloy plates, however, since the stretch-flange crack tends to be generally generated particularly in the blank of the high strength steel plate, this material is preferable as the blank material used in the present invention. As the high strength steel plate, there can be generally listed up the steel plate in which the tensile strength is about 590 MPa to 1470 MPa, however, a material in which a board thickness is about 1 to 2 mm, and the tensile strength is between about 590 MPa and 980 MPa is normally used as a press formed member for a motor vehicle.

A description will be more specifically given below of the present invention by exemplifying an embodiment, however, the present invention is not restrictively interpreted by the embodiment.

Figure 1:
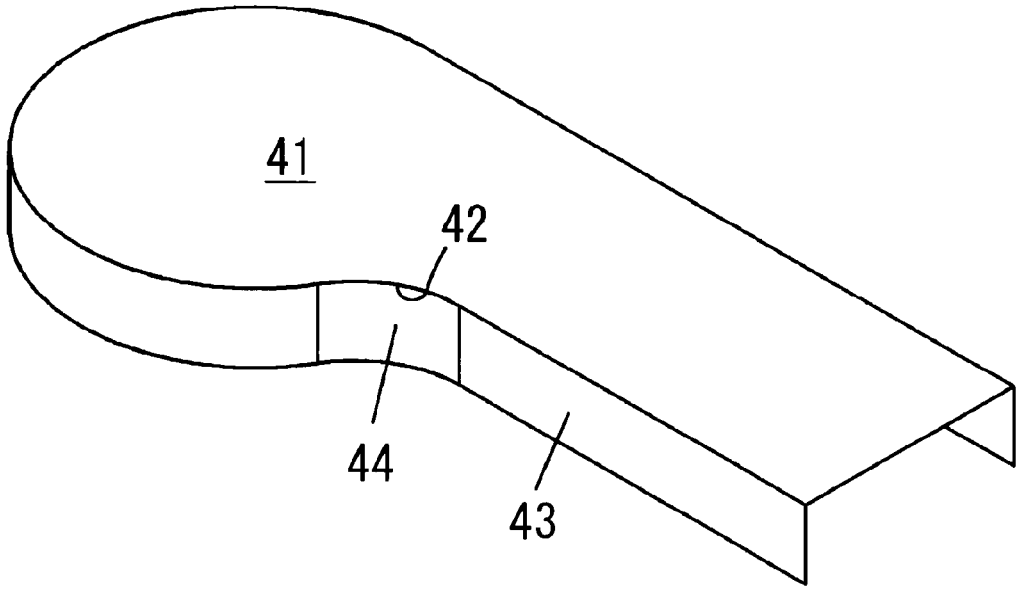
FIG. 1 is a perspective view showing an example of a formed member with flange having a concave flange portion.
Figure 2:
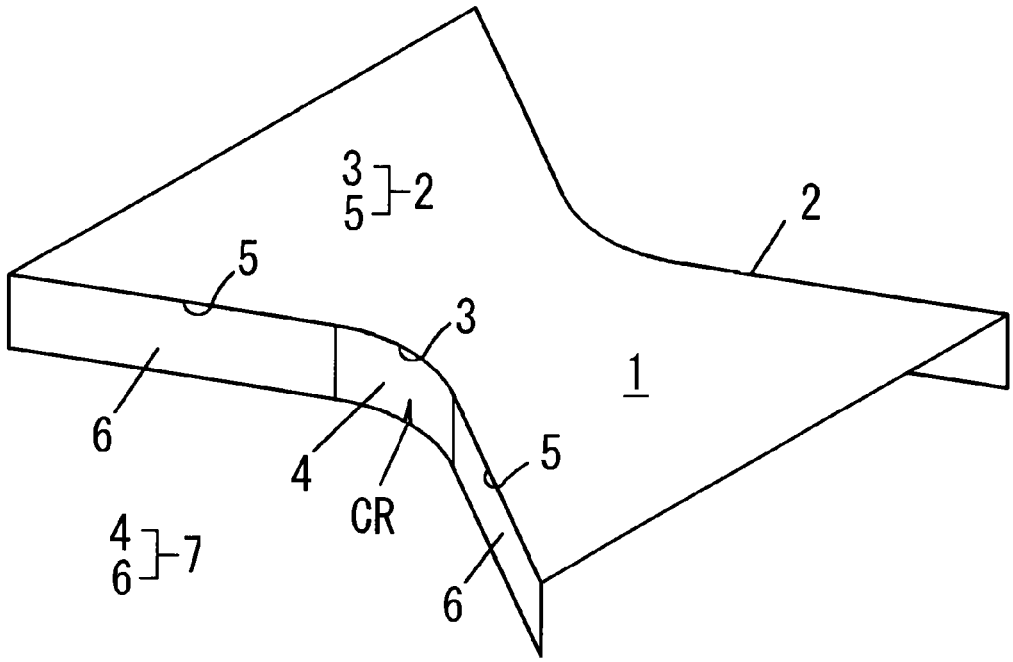
FIG. 2 is a perspective view of a formed member with flange in which a concave flange portion is formed by bending on a concave outer peripheral edge of a base body having a hourglass plane shape.
Figure 3:
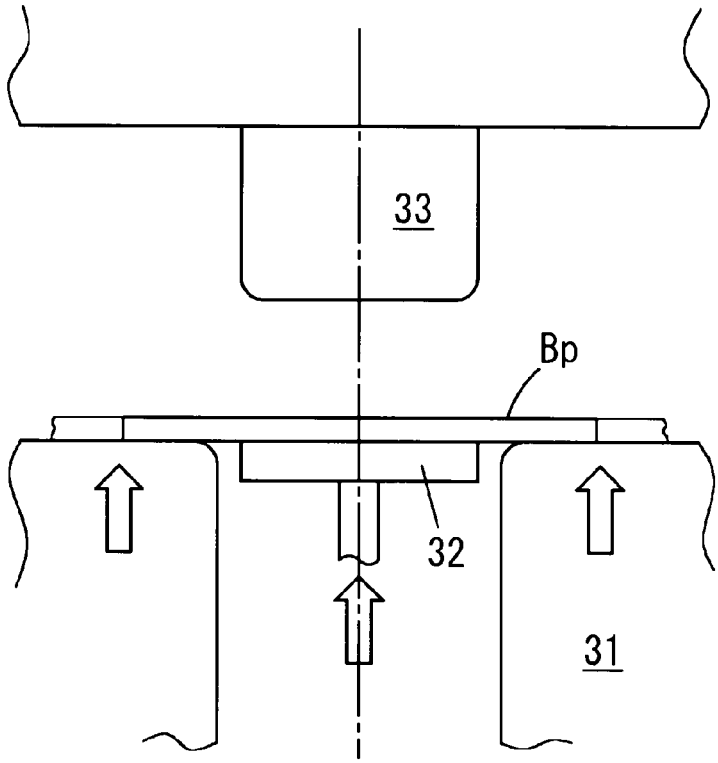
FIG. 3 is a view for explaining a forming way at a time when a blank is set to a metal mold in a press forming of the formed member with flange.
Figure 4:
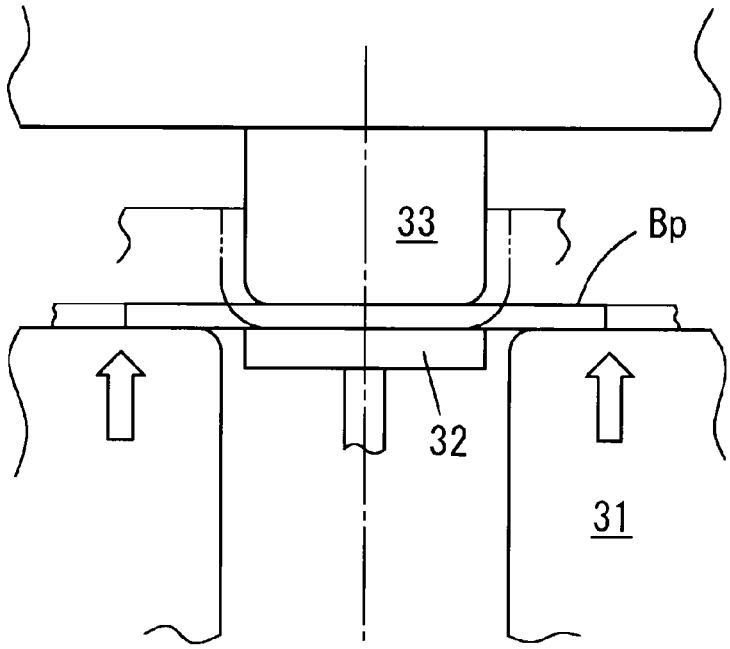
FIG. 4 is a view for explaining a forming way just before the blank is formed by bending in the press forming of the formed member with flange.
Figure 6:
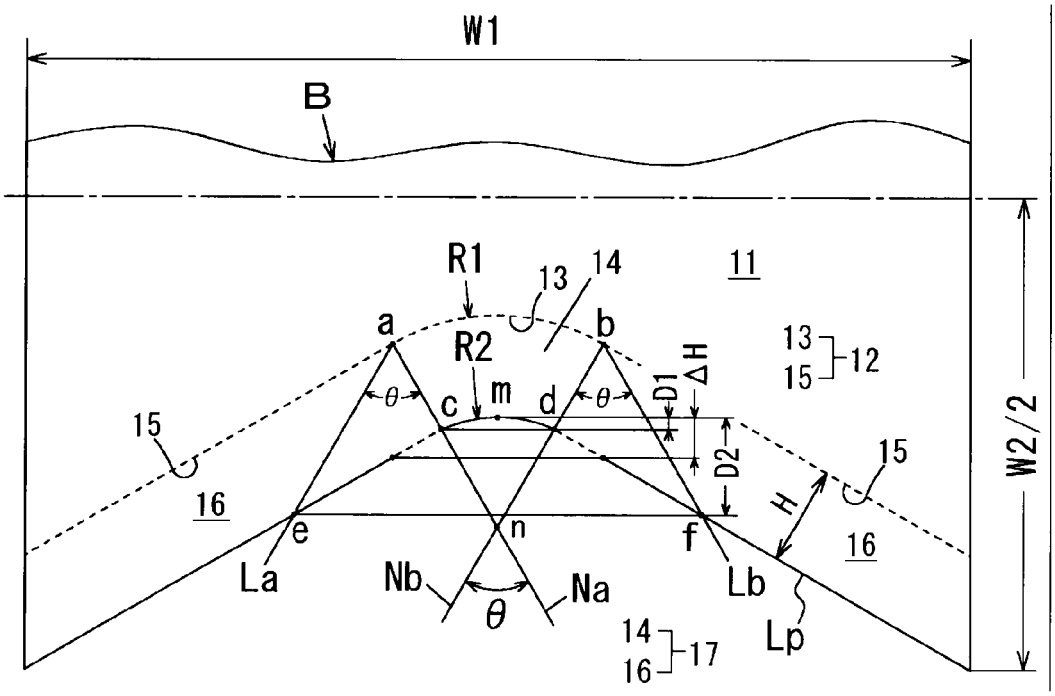
FIG. 6 is a plan view of a substantial part of a blank in accordance with the present invention of the formed member with flange having the hourglass plane shape.
Figure 7:
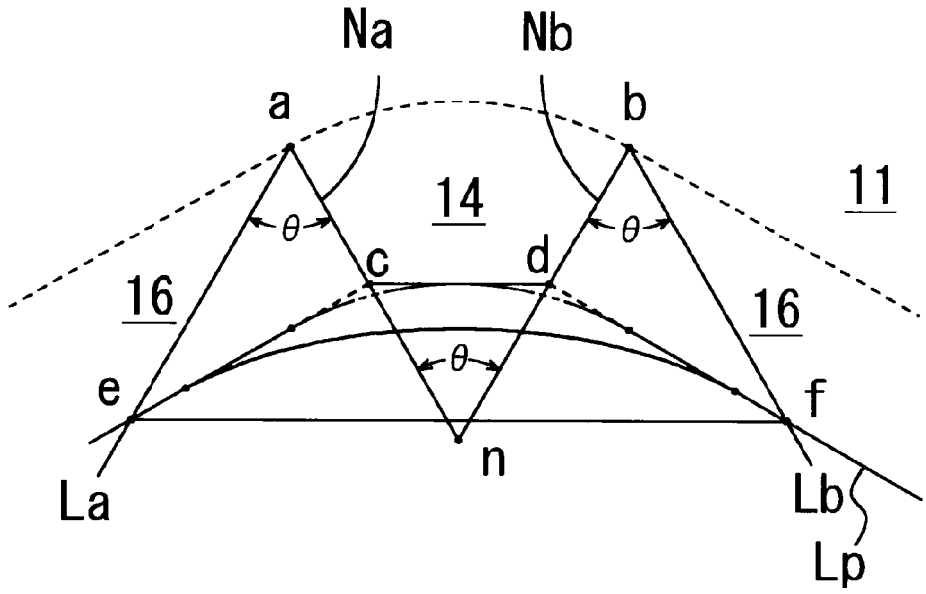
FIG. 7 is an enlarged plan view of a convex flange blank portion and its periphery.

The formed member with flange shown in FIG. 2 is formed by bending in accordance with a way in FIG. 3 by using a blank shown in FIG. 6. The blank is set to have dimensions W1=200 mm and W2=130 mm, and there are prepared various blanks having various θ, R1, H, ΔH, D1 and D2 shown in Table 1 (cold rolled steel plates having thickness 1.4 mm and tensile strength 980 MPa). The AH corresponds to an interval from a center point m of the circular arc cd having an equal radius to a radius R1 of the circular arc ab to an outer peripheral edge (a linear shape) of the convex flange blank portion 14 provided in parallel to the straight line cd, and D1 and D2 respectively correspond to intervals between m and the straight lines cd and ef. Further, in each of the blanks, the linear outer peripheral edge of the convex flange blank portion 14 and an outer peripheral edge of the adjacent flange blank 16 are smoothly coupled via a round portion having a radius 5 mm. At this time, an end point of the round portion is structured such as not to protrude to an outer side than the straight line ef. Further, in samples Nos. 1, 2 and the like of the conventional examples, R1=R2 is set.

After the press forming, with or without the stretch-flange crack in the convex flange portion 4 is observed, and a maximum thickness reducing rate of the portion is measured. As a result of these observations, results of measurement are shown in Table 1.

TABLE 1

| Sample No. | R1 (mm) | θ (°) | H (mm) | D1 (mm) | D2 (mm) | ΔH (mm) | Crack generated: ○ not generated: x | Maximum thickness reducing rate (%) | Remarks |
|---|---|---|---|---|---|---|---|---|---|
| 1 | 70.0 | 60 | 20.0 | 6.5 | 23.9 | 0.0 | ○ | 18 | Conventional example |
| 2 | 70.0 | 60 | 21.0 | 6.4 | 24.6 | 0.0 | x | 33 | Conventional example |
| 3 | 70.0 | 60 | 21.0 | 6.4 | 24.6 | 3.0 | x | 34 | Comparative example |
| 4 | 70.0 | 60 | 21.0 | 6.4 | 24.6 | 10.0 | ○ | 23 | Invention example |
| 5 | 70.0 | 60 | 21.0 | 6.4 | 24.6 | 26.0 | x | 35 | Comparative example |
| 6 | 70.0 | 60 | 21.0 | 6.4 | 24.6 | 18.0 | ○ | 21 | Invention example |
| 11 | 45.0 | 60 | 14.0 | 4.0 | 16.2 | 0.0 | ○ | 19 | Conventional example |
| 12 | 45.0 | 60 | 15.0 | 3.9 | 17.0 | 0.0 | x | 34 | Conventional example |
| 13 | 45.0 | 60 | 15.0 | 3.9 | 17.0 | 1.0 | x | 35 | Comparative example |
| 14 | 45.0 | 60 | 15.0 | 3.9 | 17.0 | 12.0 | ○ | 24 | Invention example |
| 15 | 45.0 | 60 | 15.0 | 3.9 | 17.0 | 19.0 | x | 36 | Comparative example |
| 21 | 30.0 | 60 | 11.0 | 2.5 | 12.0 | 0.0 | ○ | 20 | Conventional example |
| 22 | 30.0 | 60 | 13.0 | 2.2 | 13.5 | 0.0 | x | 33 | Conventional example |
| 23 | 30.0 | 60 | 11.0 | 2.5 | 12.0 | 1.0 | x | 34 | Comparative example |
| 24 | 30.0 | 60 | 13.0 | 2.2 | 13.5 | 8.0 | ○ | 23 | Invention example |
| 25 | 30.0 | 60 | 11.0 | 2.5 | 12.0 | 14.0 | x | 35 | Comparative example |
| 31 | 15.0 | 60 | 6.0 | 1.2 | 6.4 | 0.0 | ○ | 17 | Conventional example |
| 32 | 15.0 | 60 | 8.0 | 0.9 | 7.9 | 0.0 | x | 35 | Conventional example |
| 33 | 15.0 | 60 | 8.0 | 0.9 | 7.9 | 2.0 | ○ | 22 | Invention example |
| 34 | 15.0 | 60 | 6.0 | 1.2 | 6.4 | 7.0 | x | 34 | Comparative example |
| 35 | 15.0 | 60 | 6.0 | 1.2 | 6.4 | 3.0 | ○ | 22 | Invention example |
| 36 | 15.0 | 60 | 7.0 | 1.0 | 7.1 | 0.0 | x | 34 | Conventional example |
| 37 | 15.0 | 60 | 7.0 | 1.0 | 7.1 | 5.0 | ○ | 18 | Invention example |
| 38 | 15.0 | 60 | 7.0 | 1.0 | 7.1 | 8.0 | x | 33 | Comparative example |

Referring to Table 1, in a case that the linear outer peripheral edge of the convex flange blank portion 14 exists within a proper range, it is confirmed that the generation of crack is suppressed in the conventional example even in the case of the flange height in which the stretch-flange crack is generated, and a critical flange height generating no stretch-flange crack is improved in the present invention at 5% (sample No. 4) at the lowest in comparison with the conventional one.

For example, with reference to the samples Nos. 1 to 6, the crack is not generated in the convex flange portion at H=20 mm in No. 1 corresponding to the conventional blank, however, the stretch-flange crack is generated in the lower end of the center portion at H=21 mm. Further, in the samples Nos. 1 and 2 of the conventional examples, the maximum thickness reduction is generated in the lower end of the center portion of the convex flange portion. On the other hand, in the sample No. 4 in accordance with the invention example, the stretch-flange crack is not generated even at H=21 mm, the maximum thickness reduction is generated in the lower ends of both the end portions of the convex flange portion, and the maximum thickness reduction rate is 23% on the average. However, even at H=21 mm, the thickness reduction is generated in the lower ends of both the end portions of the convex flange portion (see a portion x in FIG. 8), in the sample No. 3 in which the outer peripheral edge position of the convex flange blank portion is outside the invention range, and the stretch-flange crack is generated. Further, in the sample No. 5, the maximum thickness reduction is generated in the lower end of the center portion of the convex flange portion, and the stretch-flange crack is generated.

Further, as a result of press forming under the same condition by using a blank formed by a cold rolled steel plate having the same plane shape as the samples Nos. 4 and 35 of the invention example, a tensile strength between 590 and 780 MPa, and a thickness between 1 and 2 mm, the stretch-flange crack is not observed. Further, as a result of press forming under the same condition by coupling an outer peripheral edge of the convex flange blank portion and an outer peripheral edge of the adjacent flange blank portion by a round portion having a radius between 40 and 70 mm, andusingtheblandhavingthesameshapeconditionsandsteelplateconditions as those of the sample Nos. 4 and 35 with respect to other shape conditions and steel plate conditions, the stretch-flange crack is not observed. Further, in the case of press forming in accordance with the same way by forming an outer peripheral edge of the convex flange blank portion by an inscribed circular arc shaped curve (a two-dot chain line) of the straight lines ec, cd and df shown in FIG. 7, and using the blank having the same shape conditions and steel plate conditions as those of the samples Nos. 4 and 35 with respect to other shape conditions and steel plate conditions, the stretch-flange crack is not observed.

The invention claimed is:

1. A press forming method of forming a formed member with a flange from a blank, comprising the steps of:

forming a formed member with a flange, the formed member comprising a flat base body including a concave outer peripheral edge in which a part of the outer peripheral edge is concaved to an inner side, and the flange is formed by bending the concave outer peripheral edge of the base body, wherein the concave outer peripheral edge is provided with a convex curved portion formed by an inside convex curve in a part thereof, and an adjacent line portion formed so as to be connected to both sides of the convex curved portion, wherein the flange portion is formed by a convex flange portion formed by bending at a convex curved portion of the concave outer peripheral edge, and an adjacent flange portion formed by bending at the adjacent line portion, wherein in the blank, there are formed a base body blank portion having a flat shape which is approximately equal to a shape of the base body, and a flange blank portion including a convex flange blank portion corresponding to the convex flange portion and an adjacent flange blank portion corresponding to the adjacent flange portion, on a concave outer peripheral edge of the base body blank portion, and in the case that a and b are set to both ends of the convex flange blank portion on the concave outer peripheral edge of the base body blank portion, Na and Nb are set to normal lines of curves forming the convex curved portion of the concave outer peripheral edge drawn to the a and b, θdegree is set as an angle formed by the normal lines Na and Nb centering on a nodal point n of the normal lines Na and Nb, a profile line Lp is assumed at a position which is spaced at an equal interval to a flange height H of the adjacent flange portion on an outer side of an adjacent line portion of the concave outer peripheral edge, c and d are set to nodal points between the normal lines Na and Nb and the profile line, and e and f are set to nodal points between straight lines La and Lb forming the θdegree angle with respect to the normal lines Na and Nb and drawn to the adjacent flange blank portion from the a and b, and the profile line Lp, setting an outer peripheral edge of the convex flange blank portion such that one end exists between c and e on the profile line Lp, the other end exists between d and f, and the one end and the other end are smoothly connected between the straight lines cd and ef, and an outer peripheral edge of the adjacent flange blank portion is formed by the profile line Lp.

2. The press forming method as claimed in claim 1, wherein a shape of an outer peripheral edge of the convex flange blank portion is formed as a linear shape, wherein in a case where a radius of curvature of the convex curved portion forming a part of the concave outer peripheral edge of the base body blank portion is set to R1 mm, the outer peripheral edge of the convex flange blank portion is connected to the outer peripheral edge of the adjacent flange blank portion adjacent to the outer peripheral edge of the convex flange blank portion via a round portion having a radius equal to or more than 5 mm and equal to or less than R1 mm.

3. The press forming method as claimed in claim 1, wherein a shape of an outer peripheral edge of the convex flange blank portion is formed as an arch shaped curve.

4. The press forming method as claimed in claim 1, wherein the blank is formed by a high strength steel plate having a tensile strength between about 590 and 1470 MPa.

* * * * *